US005962960A

United States Patent [19]

Regitz et al.

[11] Patent Number: 5,962,960

[45] Date of Patent: Oct. 5, 1999

[54] CAPPED HIGH-PRESSURE DISCHARGE LAMP

[75] Inventors: Claus Regitz, Overath; Manfred Wysietzki, Lindlar; Hans-Juergen Keck, Gummersbach, all of Germany

[73] Assignee: Patent-Truehand-Gesellschaft fur Elektrische Gluelampen mbH, Munich, Germany

[21] Appl. No.: 09/004,401

[22] Filed: Jan. 8, 1998

[30] Foreign Application Priority Data

Jan. 10, 1997 [DE] Germany ..... 297 00 365 U

[51] Int. Cl.[6] ..... H01J 5/50

[52] U.S. Cl. ..... 313/331; 313/332; 313/623

[58] Field of Search ..... 313/331, 332, 313/623, 624, 625

[56] References Cited

U.S. PATENT DOCUMENTS 5,138,227 8/1992 Heider et al. ..... 313/623
5,142,195 8/1992 Heider et al. ..... 313/623

FOREIGN PATENT DOCUMENTS 0649164 10/1994 European Pat. Off. .

*Primary Examiner*—Vip Patel
*Attorney, Agent, or Firm*—William H. McNeill

[57] ABSTRACT

Inserted into the cap of a high-pressure discharge lamp is a ceramic fleece which prevents capping cement (17) from passing into the capillary (18) between the supply lead (9*a*) and pinch (5).

10 Claims, 2 Drawing Sheets

CAPPED HIGH-PRESSURE DISCHARGE LAMP

TECHNICAL FIELD

The invention relates to capped high-pressure discharge lamps. More particularly, it relates to capped high-pressure discharge lamps in which a ceramic fleece is inserted between the pinch end of the lamp and the cap which prevents capping cement (17) from passing into the capillary (18) between the supply lead (9*a*) and pinch (5).

BACKGROUND ART

U.S. Pat. Nos. 5,138,227 and 5,142,195 disclose such capped high-pressure discharge lamps for optical applications. They comprise as sole bulb a high-power discharge vessel which is capped at two ends and is provided with two mutually opposite pinches. The connection between the two electrodes and the associated caps is performed via foils which are embedded in the pinches, and via supply leads which project at the end of the pinches. They are normally made from molybdenum. The supply leads are connected to electric contacts in the caps. The caps are connected to the ends of the pinches by means of capping cement. The temperature at the ends of these pinches is approximately 330 to 350° C. in the installed state. At such high temperatures, which cause a high reactivity, it is disadvantageous that before baking the capping cement can run into the capillary forming between the supply lead and pinch end. Because of the high coefficient of thermal expansion of the capping cement, the thermal alternating load can cause the cement to burst the pinch. This leads to a reduced service life for the lamp.

Lamps having seals are previously known from EP-A 649164, for example.

DISCLOSURE OF THE INVENTION

It is an object of this invention to enhance the operation of capped high pressure discharge lamps.

It is another object of the invention to prevent egress of capping cement into lamp capillaries.

It is another object of the invention to provide a high-pressure discharge lamp in which avoids the disadvantages of the prior art and achieves a longer service life.

These objects are achieved, in one aspect of the invention, by a high-pressure discharge lamp having a discharge vessel and two lamp shanks integrally formed thereon as well as two caps fastened thereto by means of capping cement, each lamp shank having an end face at the outer end, and electrodes in the interior of the discharge vessel being connected to the caps via foils and supply leads which emerge from the end face of the lamp shank, the temperature at the outer end of the lamp shank being at least 300° C., and being characterized in that a heat-resistant separating material is inserted at least between the region of the end of the lamp shank at which the outer supply lead emerges and the cement.

The invention relates to a high-pressure discharge lamp having a discharge vessel and two lamp shanks integrally formed thereon as well as two caps fastened thereto by means of capping cement. Electrodes in the interior of the discharge vessel are connected to the caps via foils and supply leads which emerge from the lamp shank. The temperature at the outer end of the lamp shank is at least 300° C. A heat-resistant separating material is inserted at least between the region at the end of the lamp shank at which the outer supply lead emerges, and the cement. The material used must be heat-resistant to at least 400° C. Contact between the cement and capillary is thereby mechanically prevented.

The separating material is preferably absorptive. Liquid constituents of the capping cement can thereby be absorbed. Moreover, this results in removing inadvertent contamination of the capillary, since the separating material can exhaust these constituents out of the capillary again.

In a particular preferred fashion, ceramic fleece or ceramic paper, rock wool or vlies are suitable as the separating material. In the case of these materials, an axial hole can be prepunched into the separating material for the purpose of threading and holding on the supply lead.

Usually, the lamp shank is a pinch, but it can also be a seal. In the first case, the cap is preferably a slotted cap sleeve, especially made from ceramic, pushed onto the pinch.

The discharge vessel is frequently the sole bulb of the lamp.

The separating material is preferably formed such that it fits into a recess in the cap. A particularly effective retention of the separating material is achieved when it is pressed in between the lamp shank and cap.

In order reliably to fulfil the task of separation, the layer thickness of the separating material is at least 1 mm. Typical layer thicknesses are 5 to 10 mm, as the result of which tolerances in the cap can also be compensated.

The supply lead usually consists of molybdenum, and the discharge vessel of quartz glass.

This arrangement reliably prevents the capping cement from being in direct contact with the end face at the end of the lamp shank. This is particularly important in the region where the supply lead emerges from the end face of the lamp shank, since a capillary is usually present there between the supply lead and the surrounding quartz glass. The separating material prevents gaseous or liquid constituents of the capping cement from penetrating into the capillary. This is because these materials are precipitated to a large extent from the capping cement at temperatures above 300° C.

It is known to seal the capillary by means of special viscous pH neutral cement or else glass solder, as a result of which the actual free-flowing capping cement can no longer pass into the capillary. This viscous cement, as well, is not well adapted to the minimum thermal expansion of the quartz glass and can burst the pinch as the operating period increases. It is therefore unsuitable for the present invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
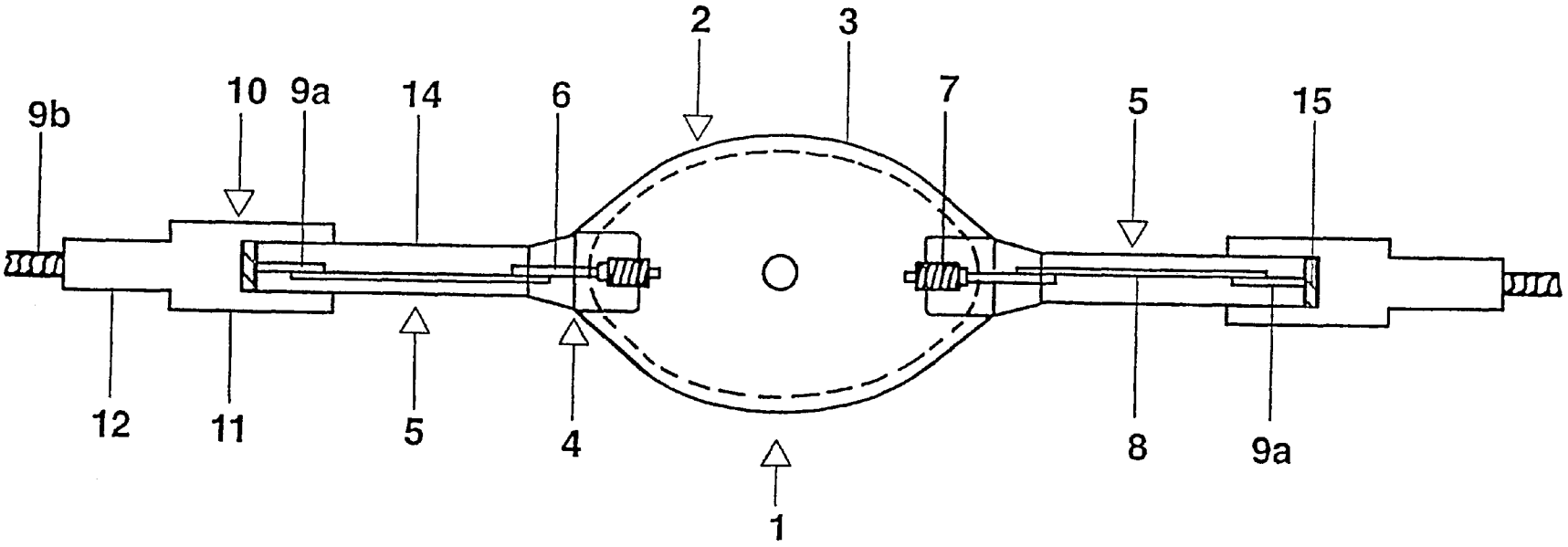
FIG. 1 shows a metal halide lamp pinched at two ends.

Represented in FIG. 1 is a 2000 W high-pressure discharge lamp 1 which requires no outer bulb. It is meant for use in a reflector (not illustrated here). It has a bulb 2, which comprises a central region and two lamp shanks which extend in diametrically opposite directions. The discharge vessel 3, which is isothermal to a good approximation and made from quartz glass, which forms the central region, is designed as a barrel-shaped body. It is a cylindrical body in another exemplary embodiment. Pinches 5 are integrally formed as lamp shanks on the ends 4 of the barrel-shaped body. Bar-shaped electrodes 6 with a filament tip 7 are held axially in the pinches 5. Via molybdenum foils 8, which are sealed in a vacuum-type fashion into the pinches 5, the electrodes 6 are connected to supply leads 9*a* made from molybdenum, which emerge at the outer end of the pinch 5. The supply leads 9*a* are connected to stranded wires 9*b* inside two ceramic sleeve caps 10. Each cap 10 comprises a hollow cylindrical retaining part 11 which is slotted over a part of its length and is pushed onto the end of the pinch 5. Adjoining the retaining part 11 towards the outside is a flattened solid end member 12 from which, in accordance with the FIG. 2, the stranded wire 9*b* is guided to the outside through an axial opening 16. Inside, the retaining part has a cylindrical recess 13 with a base 14 facing towards the end member.

Pressed in between the end face 20 on the outer end of the pinch and the base 14 of the recess is a disc-shaped ceramic fleece 15 whose thickness is approximately 8 mm. It is threaded onto the supply lead 9*a*. The ceramic fleece can also be composed of a plurality of thinner individual discs.

Figure 2:
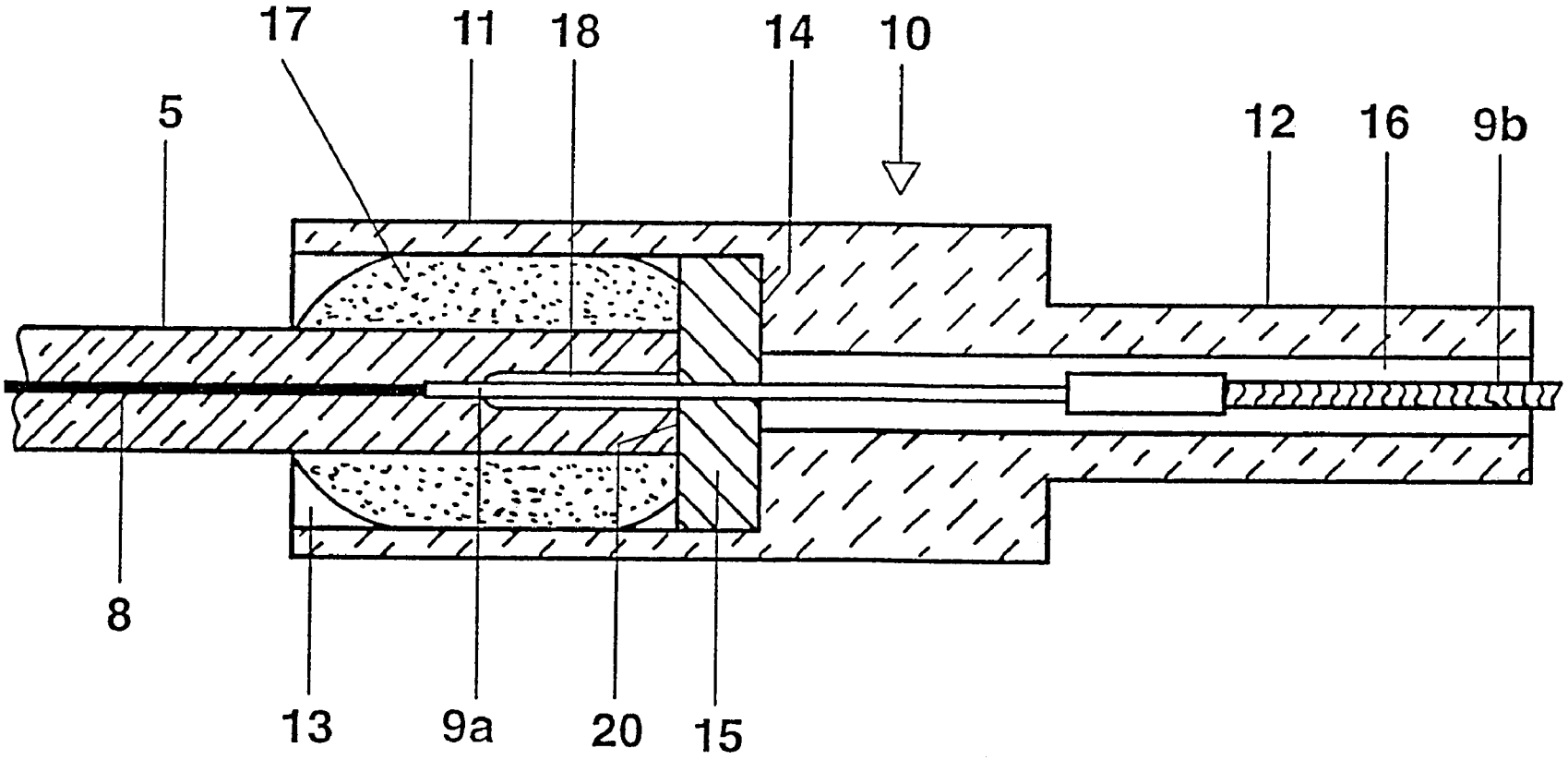
FIG. 2 shows a detail in the region of the capping of FIG. 1.

A section through the cap is shown in detail in an enlarged fashion in FIG. 2. The capping cement 17 is inserted into the recess 13 in the region of the retaining part 11. For a better understanding, the capillary 18 which forms between the supply lead 9*a* and pinch 5 is also drawn in, but not to scale. The ceramic fleece 15 prevents the capping cement 17 from being able to pass into the capillary 18.

What is claimed is:

1. A high-pressure discharge lamp having a discharge vessel and two lamp shanks integrally formed thereon as well as two caps fastened thereto by means of capping cement, each lamp shank having an end face at the outer end, and electrodes in the interior of the discharge vessel being connected to the caps via foils and supply leads which emerge from the end face of the lamp shank, the temperature at the outer end of the lamp shank being at least 300° C., characterized in that a heat-resistant separating material is inserted at least between the region of the end of the lamp shank at which the outer supply lead emerges and the cement.

2. The high-pressure discharge lamp of claim 1, characterized in that the separating material is absorptive.

3. The high-pressure discharge lamp of claim 1, characterized in that the separating material is ceramic fleece or ceramic paper.

4. The high-pressure discharge lamp of claim 3, characterized in that the lamp shank is a pinch.

5. The high-pressure discharge lamp of claim 1, characterized in that the cap is a slotted cap sleeve made from ceramic and pushed onto the pinch.

6. The high-pressure discharge lamp of claim 1, characterized in that the discharge vessel is the sole bulb of the lamp.

7. The high-pressure discharge lamp of claim 1, characterized in that the separating material is shaped such that it fits into a recess in the cap.

8. The high-pressure discharge lamp of claim 1, characterized in that the separating material is pressed inbetween the lamp shank and cap.

9. The high-pressure discharge lamp of o claim 1, characterized in that the layer thickness of the separating material is at least 1 mm.

10. The high-pressure discharge lamp of claim 3, characterized in that the separating material has a prepunched hole for threading onto the supply lead.

* * * * *